United States Patent [19]

Donnelly

[11] Patent Number: 4,531,651

[45] Date of Patent: Jul. 30, 1985

[54] BLOOD SAMPLING CONTAINERS

[76] Inventor: Thomas K. Donnelly, The Bank House, Customs Quay, Wexford, Ireland

[21] Appl. No.: 530,303

[22] Filed: Sep. 8, 1983

[30] Foreign Application Priority Data

Sep. 8, 1982 [GB] United Kingdom ..... 8225544

[51] Int. Cl.[3] ..... B65D 41/28

[52] U.S. Cl. ..... 215/354

[58] Field of Search ..... 215/354, 274, 276, 296, 215/247

[56] References Cited

U.S. PATENT DOCUMENTS 1,479,985 1/1924 Enomoto ..... 215/354
3,499,568 3/1970 Riera ..... 215/247 X
3,847,295 11/1974 Taylor ..... 215/276 X
3,924,772 12/1975 Magnani ..... 215/354 X
4,067,473 1/1978 Awer et al. ..... 215/296 X

FOREIGN PATENT DOCUMENTS 17030 of 1915 United Kingdom ..... 215/274

*Primary Examiner*—Donald F. Norton
*Attorney, Agent, or Firm*—Millen & White

[57] ABSTRACT

There is disclosed a closure, more particularly but not exclusively used for blood sampling tubes. The closure comprises a core section of elastomeric material constructed and arranged to be received at least partially within the tube, i.e., the container, and an annular outer section of substantially non-elastomeric material disposed radially of the core section. The annular section is spaced from the core section over a part of its length to provide an annular recess for receipt of the container neck.

13 Claims, 6 Drawing Figures

BLOOD SAMPLING CONTAINERS

BACKGROUND OF THE INVENTION

This invention relates to blood sampling containers such as tubes or bottles and to stoppers or closures therefor.

Containers are for the present provided in hospitals, clinics an the like for use in blood sampling in various forms to suit differing particular requirements as dictated by medical and/or financial factors. At their simplest blood sampling tubes or bottles are provided either with a screw thread to be closed with a screw cap or with a plain neck closed by a deformable press-on cap or a cork or similar plug. The former arrangement can be made to various tolerances and hence seal but in general the finer the tolerance, the greater the cost; the latter has the benefit of cheapness of manufacture both of tube or bottle and of the closure means but the seal afforded is generally not up to the highest medical requirements. For such uses it is frequently the case that the stopper or closure must be capable of holding a vacuum in the tube or bottle and to achieve this reliance is usually placed upon the use of tight fitting rubber or butyl rubber stoppers or bungs in tubes or bottles having plain ends or necks. The tight fit is achieved by providing a portion of the stopper or bung with an external diameter slightly greater than the internal diameter of the tube which it is to fit, the compression of the rubber against the glass or similar material of the tube or bottle providing a vacuum seal.

It is with such vacuum holding blood sampling containers with which the present invention is particularly concerned but it is anticipated that the container and closure arrangement of the invention could well find widespread use in circumstances where economics previously dictated the use of an arrangement with a lower specific performance.

The rubber stopper or bung arrangement discussed above presents substantial disadvantages. Firstly removal of the closure can be difficult for laboratory personnel bearing in mind that this usually needs to be effected single handed and even when the closure is provided with an upper portion of diameter marginally greater than that of the tube end or neck, this difficulty may lead to traumatised thumbs and/or a reduction in the speed of processing. Furthermore removal of a rubber bung from a closed container is believed to create what is known as the "aerosol effect"—a sudden change in pressure resulting in vaporisation of part of the contents of the container. This can be dangerous, particularly if the blood in the container is contaminated for example with hepatitis virus. The aerosol effect is generally the greater as the size of container increases. A part of the rubber of the closure will be in contact with the blood within the container; on removal of the closure contamination of laboratory personnel and of surrounding surfaces may be difficult to avoid even should the "aerosol effect" not occur. As a final example of user related problems, the replacement of a rubber closure on a partially filled container may be followed by expulsion of the closure due to the increase pressure produced within the container. The greater the mass of the closure, or at least the greater the length of closure which enters the container neck, the more likelihood of expulsion.

To turn to manufacturing and supply difficulties, the cycle time of rubber moulding is high as against generally used plastics materials, the cost, weight for weight, likewise being substantially higher for rubber materials as opposed to generally used plastics materials. Furthermore the need for a close internal fit for various container sizes necessitates provision of a number of sizes of closure with consequent increase in tooling costs and the levels of stocks required, this being made the worse as hospitals, clinics and the like require provision of closures in a number of different colours to assist in cataloging and the like. This can increase the requirement for stock levels perhaps a further 6 to 10 fold. In manufacturing too the colour coding can cause further difficulties relative to plastics materials as rubber materials are by and large considerably less receptive to subtleties of colouration and more expensive as a result.

SUMMARY OF THE INVENTION

It is an object of the invention to produce a container and closure arrangement which overcomes some or all of these disadvantages e.g. in terms of providing an arrangement with a higher specific performance economically. The containers of the present specification may be tubes or bottles, these terms being substantially equivalent unless the context provides to the contrary.

The present invention in one aspect provides for a closure, for use more particularly but not exclusively on blood sampling containers, comprising a core section of elastomeric material constructed and arranged to be received at least partially within a container, and an annular outer section of substantially non-elastomeric material disposed radially of the core section, the annular section being spaced from the core over a part of its length to provide an annular recess for receipt of the container neck.

The core section is preferably of rubber or butyl rubber material and the annular section preferably of plastics material, for example material such as polyethylene, polypropylene or other similar or suitable plastic material. The core and annular sections are preferably substantially co-axial and may be affixed to one another by circumferential contact over a part of the length of each or by location of a radial inwardly extending flange on the annular section in a circumferential groove or recess in the core section. Affixation of the section one to another may be through friction alone, friction augmented by complementary irregularities on the surfaces of the two sections, or may be assisted or augmented by adhesion, for example from applied adhesive material as from appropriate solvent effect on one or other section.

The annular section in a preferred form of the invention may comprise a cylindrical portion and an inwardly extending annular flange, the flange being received at least partially within an annular groove in the core portion, to retain the annular and core portions together as a closure. Substantially all of the cylindrical portion may depend from the flange, that is to say the flange may be affixed to the cylindrical portion at or adjacent an end thereof.

The non-elastomeric material of the annular section is preferably substantially form retaining in the sense that it will resist permanent deformation under manipulation for example by a laboratory assistant placing enough manual pressure on the annular section to remove the core portion from the neck of a tube into which it has been inserted. Non-plastic materials and indeed rigid materials may be used but it is anticipated that plastics materials may provide the optimum of performance and cost particularly bearing in mind their ease of colouration and variation of colouration.

The annular recess provided between the core and annular sections may be defined by an annular step on either the core section or the annular section or both. Where an annular step on both is provided, the steps in the assembled closure are preferably substantially coplanar and substantially at right angles to the axis of the closure, the two steps therefore providing a substantially planar base to the said recess. The recess may also be defined by, for example, an annular step in the core section, the part of the flange of the annular section not received within the said groove, and, the said cylindrical skirt portion, or by the said flange alone together with the skirt portion.

The external diameter of the core section over at least the part thereof forming the inner wall of the recess is such that it is slightly greater than the internal diameter of the neck of the container it is to fit in the manner discussed above in relation to prior art closures. The leading annular edge of the core section may be chamfered or rebated for ease of entry into the container. The inner surface of the annular section providing the outer wall of the said recess is preferably such that it is spaced from the outer surface of the neck of the tube in use. The said outer wall of the recess may be provided with discreet or annular irregularities, e.g. beads or grooves which may bear against the said external surface of the tube neck. The said irregularities may be of such shape and dimensions that they resist removal of the closure from the container. They may further be designed to cooperate with similar irregularities for example annular grooves or beads on the neck or rim of the tube, the respective irregularities providing in effect a ratchet arrangement which can be overriden by distortion of the annular section. This facility when provided seeks to reduce the incidence of expulsion of the closure as discussed above. In further forms complementary irregularities on the skirt and tube may be spaced from one another when the tube and closure are in a normal concentric relationship, but engage on distortion e.g. by application of thumb pressure.

The annular section preferably provides a skirt depending in use below the lower extremity of the core section. Thus the outer wall of the recess provided by the annular section is longer in an axial sense than the inner wall of the recess provided by the core section. The lower annular edge of the annular section may be chamfered or rebated such that if used with a container having a neck of an appropriate length it may provide a further, albeit low performance, seal with the container shoulder. The presence of the skirt is believed to assist in several ways including by decreasing the force of air entering the container on removal of the closure and, should an aerosol effect still occur, containing that aerosol within the confines of the closure. It will also prevent the users thumb from coming into contact with the core portion which may be contaminated by the tube contents.

The invention also relates to an annular section for a closure, which closure may be as defined above, comprising a cylindrical portion as an inwardly extending annular flange, and to a core section for use with such an annular section to form a closure as defined above.

In a further aspect the invention provides in combination a closure as described above and a selected one of a plurality of containers of varying capacity but substantially equivalent neck construction. The containers, are preferably of glass or similar material such as plastic. The invention also relates to a container for use in the above combination.

With the closure of the present invention it is believed that a number if not all of the above discussed disadvantages may be removed or at least mitigated. It is expected that a closure of the present invention will permit easy singlehanded removal from a container; reduce the risk of spread of infection through "aerosol effect" (by decreasing the force of air entering the container on opening and by containing substantially any aerosol formed within its umbrella); provide a means for minimising the likelihood of expulsion of the closure through internal pressure; prevent contact of a blood contaminated internal core with a hand of the user or surrounding surfaces; and allow for cheap and easy colour coding by the expedient of manufacturing in a plurality of colours easily and cheaply mouldable non-elastomeric annular sections and a single colour single size core portion of one acceptable colour only.

When containers of larger capacity are used and a shoulder formed to accommodate the larger capacity it is note worthy that the closure of the present invention will provide, volume for volume a lesser amount of closure within the container.

The invention resides in any of the features discussed above or as discussed in relation to the following specific embodiment, either individually or in combination with any number of other features.

BRIEF DESCRIPTION OF THE INVENTION

The invention may be put into practice in a variety of ways but a closure and a closure and tube arrangement will now be described, by way of example, with reference to the accompanying drawings all of which are cross-sectional views along a diameter in a substantially axial plane in which.

DETAILED DISCUSSION OF THE INVENTION

Figure 1:
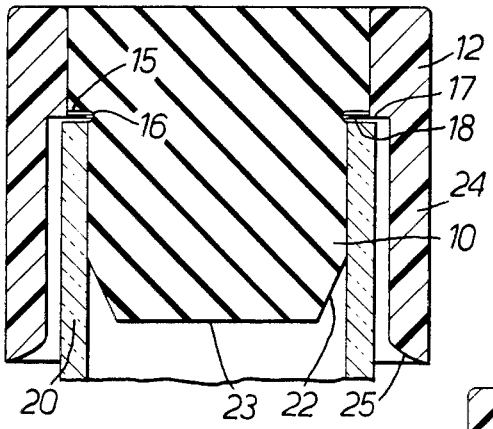
FIG. 1 shows a closure embodying the invention and part of the neck of a tube.

Referring to the FIG. 1 there is shown in a core section 10 and an annular section 12 which together form the closure embodying the invention. The core section 10 is made of butyl rubber and has two portions, an upper and a lower portion delineated by an annular step 15. The core section 10 and all of its circumferential surfaces are substantially cylindrical of constant radius. The upper portion has a larger radius than the lower portion. The radius of the lower portion is arranged to be slightly greater than the internal diameter of the neck of the tube 20 to which it is to be applied, the tube neck likewise being circular in section and of substantially constant radius, such that location of the lower portion of the core section into the tube 20 causes compression of the part of the core section in contact with the tube to form a seal. The compression of the lower portion of the core section 10 can be seen particularly well in FIG.

4 in which the core section 10 is not fully home into the tube 20.

The terms "upper" and "lower" used herein are in the sense as shown in the accompanying drawings, it being the lower portion of the core section 10 which is introduced into the neck of the tube 20. For ease of introduction of the core section 10 into the neck of the tube 20 the lower annular edge of the core section 10 may be chamfered as shown at 22 in FIG. 1.

An annular groove 16 is provided at the junction between upper and lower portions of the core section 10 as a continuation of the annular step 15 for reasons which will become apparent below.

The annular section 12 is constructed of polyethylene polypropylene or other similar or suitable plastics material and again comprises upper and lower portions this time defined by an annular step 17. The axial length of the upper portion of the core section 10 and the upper portion of the annular sections 12 are substantially the same, the internal diameter of the annular section 12 being slightly less than the external diameter of the upper portion of the core section 10 so that when the core section 10 is located within the annular section 12 as shown in the drawing it is retained in place by the resilience of the butyl rubber under compression. The annular section 12 is further provided with a radial flange 18 extending inwardly located to be received within the annular groove 16 of the core section 10. Co-operation of the flange 18 and the groove 16 helps lock the core section 10 and annular section 12 to one another and resist any tendency of the latter to ride over the former when removing the closure from the tube 20.

The lower portion of the annular section 12 has an internal radius greater than the external radius of the neck of the tube 20 thus forming with the lower portion of the core section 10 an annular recess for receipt of the neck of the tube 20. The lower portion of the section 12 is thus in use spaced from the surface of the external wall of the neck of tube 20 and thus forms in effect a free standing depending skirt 24. The skirt 24 extends below the lower surface 23 of the core section 10 and may be chamfered or rebated at its lower annular edge 25.

From the manufacturing viewpoint an appropriate large number of core sections 10 may be manufactured of butyl rubber of an acceptable colour and then assembled with the same number of annular sections 12, the latter being made up of a plurality of different coloured plastics mouldings to provide colour coded closures.

To reduce the amount of butyl rubber material used in the formation of the core sections 10, the upper and lower surfaces thereof may be dished or otherwise recessed in a manner not shown but conventional.

Either or both sections 10 and 12 may be embossed in the moulding procedure with legible letters or digits as an indication of origin, advertisement or further coding.

Turning now to the second embodiment as shown in FIGS. 2 to 5, the core section 10 is as that described in relation to FIG. 1. The annular section 12' is equivalent to annular section 12 as described in relation to FIG. 1 in all material respects save for the provision of circumferentially extending irregularities 30 and 31 located on the internal wall of the lower portion of section 12'. The prime operation of these irregularities 30 and 31 is to impinge against a circumferential bead 35 located on the external surface at the upper edge of the neck of the tube 20' to resist expulsion of the closure from the tube. The irregularities 30 and 31 are preferably of substantially triangular cross-section with the lower free surface thereof at a more acute angle to axial than the upper surface thereof so that they may more easily be ridden over the bead 35 when placing the closure on the tube 20' than in the reverse direction, greater distortion of the annular section 12' being necessary for the said movement in the reverse direction to remove the closure from the tube 20'. As will be seen from FIG. 4 (and indeed FIG. 5) the locking performance of the irregularity 30 against the beading 35 may be effective even when the closure is not fully home into the tube 20'.

Figure 2:
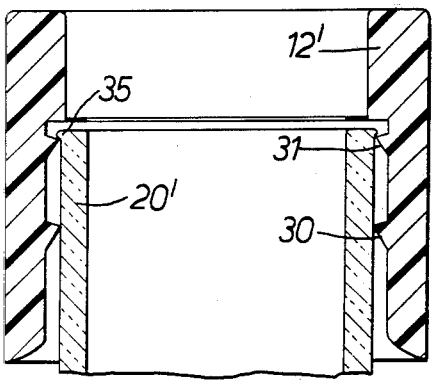
FIG. 2 shows an annular section of a further closure embodying the invention together with a section of the neck of a tube.
Figure 3:
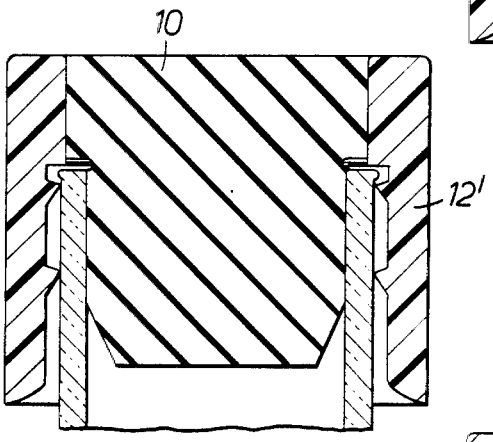
FIGS. 3, 4 and 5 show the arrangement of FIG. 2 with the core section in place, in the case of FIG. 4 with the closure not fully home in the tube neck.
Figure 4:
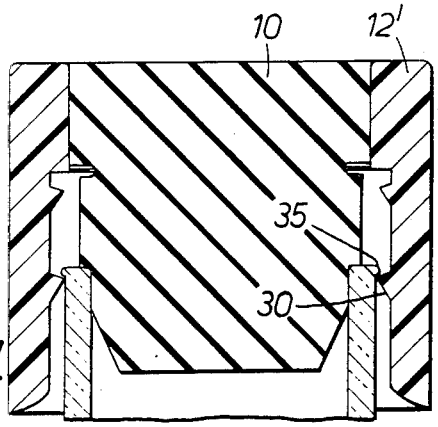

The irregularities 30 and 31 remain slightly clear of the external surface of the neck of the tube 20' with the closure in its position as shown in FIG. 2. In a further embodiment (not shown) they may extend so that they engage the outer surface of the said neck for further frictional resistance against removal of the closure.

Figure 5:
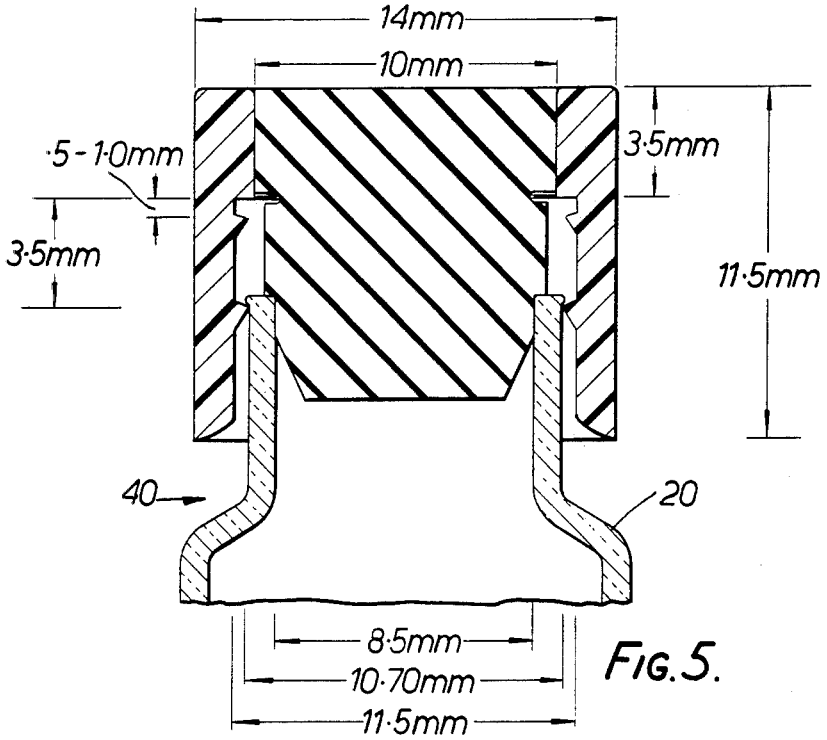

The tube 20 or 20' may be substantially cylindrical of constant radius or may be provided with variations along its length in its radius for example by increase to form a shoulder 40 as shown in FIG. 5. The skirt 24 formed by the lower portion of annular section 12 or 12' is therefore preferably constructed either to abut or to come close to abutting the glass of the tube 20 or 20' at the shoulder 40 thereof. Where a rebate 25 is provided it may preferably conform to the shape of the shoulder 40.

FIG. 5 also provides typical dimensions of a closure for a blood sampling tube. A prepared shouldered body 20 would have a tooled neck of approximately 8 mm in length.

In a further form of the invention not shown the irregularities 30 and 31 are discontinuous on a circumferential basis there being three discreet irregularities located in the same circumferential plane.

Figure 6:
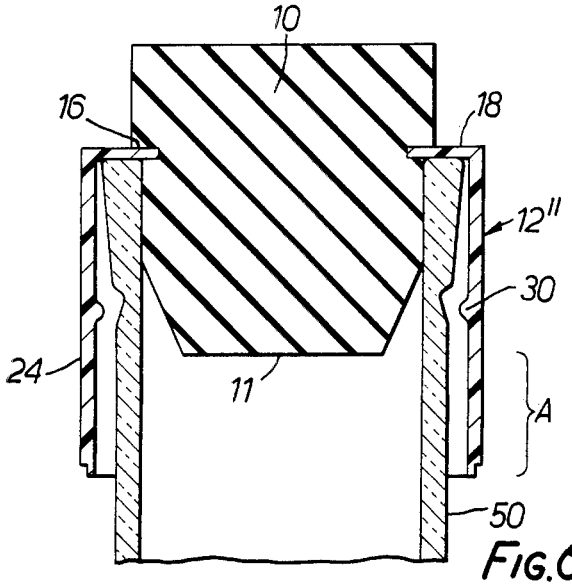
FIG. 6 shows a further closure embodying the invention and part of the neck of a tube.

Referring now to FIG. 6 there is shown again a butyl rubber core section 10 as before and a plastic annular section 12" fitted over the neck of a tube 50. The fitment of the core 10 into the tube 50 is as described above. The annular section 12" comprises a radial inwardly extending annular flange 18 and a dependent cylindrical skirt portion 24. Extending axially below the base 11 of the core 10 by a distance A. The flange 18 is received within a groove 16 to hold the sections 10 and 12 together as before. The upper part of the neck of the tube 50 is received within the recess defined between the upper part of the skirt 24 and the lower portion of the core 10 making a substantially force fit with the core 10 and being substantially spaced from the skirt 24. The skirt 24 is provided with an annular bead 30 in alignment with an annular recess on the external surface of the neck of the tube 40. The tube may be provided with a bead 35 (as before but not shown) to cooperate with the bead 30 to resist expulsion of the closure.

I claim:

1. A closure for a container comprising a core of elastomeric material constructed of a shape and arranged for being received at least partially within the container, and an annular outer section of substantially non-elastomeric material disposed radially with respect to the core section over a part of its length to provide an annular recess for receipt of the container neck, said annular recess being defined by an inner wall comprised of said core section, an outer wall comprised of said annular section and a base comprised of a connection between said core section and said annular section, and said connection between said core section and said annular section being comprised of an extension of said annular section into a groove located in said core section, such that said extension of said annular section contacts the top surface of the mouth of the container when the closure is in use in sealing a container.

2. A closure as claimed in claim 1 in which the core section is made of rubber and/or butyl rubber.

3. A closure as claimed in claim 1 further comprising in combination a selected one of a plurality of containers of various volumetric capacities but constructed with substantially equivalent neck sizes, and the closure having the elastomeric core portion of a diameter slightly larger than the diameter of the inner portion of the neck of the container such that the core portion is compressed upon being inserted in the neck for sealing of the container.

4. A closure as claimed in claim 1 in which the annular section is made of plastics material.

5. A closure as claimed in claim 1 in which the annular section comprises a cylindrical portion and said extension thereof is an inwardly extending annular flange.

6. A closure as claimed in claim 5 in which substantially all of said cylindrical portion depends from said flange.

7. A closure as claimed in claim 5 in which the said cylindrical portion depends axially below the lower extremity of the core section.

8. A closure as claimed in claim 1 wherein said core section extends outwardly at least over a portion of said extension.

9. A closure for a container comprising a core of elastomeric material constructed of a shape and arranged for being received at least partially within the container, and an annular outer section of substantially non-elastomeric material disposed radially with respect to the core section over a part of its length to provide an annular recess for receipt of the container neck, said annular recess defined by an inner wall comprised of said core section, an outer wall comprised of said annular section and a base comprised of a connection between said core section and said annular section, and said connection between said core section and the annular section being comprised of an extension of said annular section, in a substantially horizontal direction into a groove in the core section, such that said extension of said annular section contacts the top surface of the mouth of the container when in use in sealing a container, and with substantially all of the annular section depending downwardly from said extension.

10. A closure as claimed in claim 9 in which the annular section comprises a cylindrical portion and an inwardly extending annular flange.

11. A closure as claimed in claim 10 in which said flange comprises said extension which is at least partially received within the groove in the core portion, for retaining the annular and core portions together as a closure.

12. A closure as claimed in claim 10 in which the said cylindrical portion depends axially below the lower extremity of the core section.

13. A closure as claimed in claim 9 further comprising in combination a selected one of a plurality of containers of various volumetric capacities but constructed with substantially equivalent neck sizes, and the closure having the elastomeric core portion of a diameter slightly larger than the diameter of the inner portion of the neck of the container such that the core portion is compressed upon being inserted in the neck for sealing of the container.

* * * * *